US010109920B2

(12) United States Patent
Shrekenhamer et al.

(10) Patent No.: US 10,109,920 B2
(45) Date of Patent: Oct. 23, 2018

(54) METASURFACE ANTENNA

(71) Applicant: The Johns Hopkins University, Baltimore, MD (US)

(72) Inventors: David B. Shrekenhamer, Silver Spring, MD (US); Joseph A. Miragliotta, Ellicott City, MD (US); Kenneth R. Grossman, Olney, MD (US)

(73) Assignee: The Johns Hopkins University, Baltimore, MD (US)

( * ) Notice: Subject to any disclaimer, the term of this patent is extended or adjusted under 35 U.S.C. 154(b) by 404 days.

(21) Appl. No.: 14/946,300

(22) Filed: Nov. 19, 2015

(65) Prior Publication Data

US 2017/0069967 A1 Mar. 9, 2017

Related U.S. Application Data

(60) Provisional application No. 62/216,114, filed on Sep. 9, 2015.

(51) Int. Cl.
*H01Q 9/04* (2006.01)
*H01Q 3/26* (2006.01)

(52) U.S. Cl.
CPC ..... *H01Q 9/0442* (2013.01); *H01Q 3/26* (2013.01); *H01Q 9/0407* (2013.01)

(58) Field of Classification Search
CPC ..... H01Q 9/0442; H01Q 9/0407; H01Q 3/26; H01Q 13/18; H01Q 15/0006; G02F 1/0063
See application file for complete search history.

(56) References Cited

U.S. PATENT DOCUMENTS

| | | | | |
|---|---|---|---|---|
| 6,992,629 | B2 | 1/2006 | Kerner et al. | |
| 7,307,589 | B1 | 12/2007 | Gregoire et al. | |
| 7,393,699 | B2 | 7/2008 | Tran | |
| 7,461,444 | B2 | 12/2008 | Deaett et al. | |
| 7,859,414 | B2 | 12/2010 | Kai et al. | |
| 8,878,741 | B2 | 11/2014 | Mosallaei | |
| 8,940,117 | B2 | 1/2015 | Slafer | |
| 2006/0237537 | A1 | 10/2006 | Empedocles et al. | |
| 2013/0208332 | A1* | 8/2013 | Yu | H01Q 15/0006 359/240 |
| 2013/0313328 | A1* | 11/2013 | Mohajer-Iravani | H01Q 13/18 235/492 |
| 2014/0085693 | A1 | 3/2014 | Mosallaei et al. | |

(Continued)

FOREIGN PATENT DOCUMENTS

| | | |
|---|---|---|
| WO | 1997/049536 | 12/1997 |
| WO | 2012/139071 | 10/2012 |

OTHER PUBLICATIONS

D. Souriou et al., Antenna Miniaturization and Nanoferrite Magneto-Dielectric Materials, 14th International Symposium on Antenna Technology and Applied Electromagnetics [ANTEM] and the American Electromagnetics Conference, 2010 (Year: 2010).*

(Continued)

*Primary Examiner* — Bernarr E Gregory
*Assistant Examiner* — Fred H Mull
(74) *Attorney, Agent, or Firm* — Sung T. Kim

(57) ABSTRACT

An antenna is provided including an electromagnetic metasurface. The electromagnetic characteristics of the antenna are dynamically tunable.

18 Claims, 6 Drawing Sheets

(56) References Cited

U.S. PATENT DOCUMENTS

| | | | | |
|---|---|---|---|---|
| 2014/0277433 | A1 | 9/2014 | Pugh et al. | |
| 2017/0235162 | A1* | 8/2017 | Shaltout ..... | G02F 1/0063 359/9 |

OTHER PUBLICATIONS

D.J. Gregoire, 3-D Conformal Metasurfaces, IEEE Antennas and Wireless Propagation Letters, vol. 12, p. 233-236,2013 (Year: 2013).*

G. Oliveri et al., Reconfigurable Electromagnetics Through Metamaterials—A Review, Proceedings of the IEEE, vol. 103(7), p. 1034-1056, Jul. 2015 (Year: 2015).*

* cited by examiner

METASURFACE ANTENNA

CROSS REFERENCE TO RELATED APPLICATIONS

This application claims the benefit of U.S. Provisional Application No. 62/216,114 filed on Sep. 9, 2015, the entire contents of which are hereby incorporated herein by reference.

TECHNICAL FIELD

Example embodiments generally relate to radio frequency antennas and, in particular, relate to a metasurface antenna.

BACKGROUND

Antennas for use in the high frequency (HF) and ultra high frequency (UHF) bands have traditionally utilized "whip" designs. These whip antennas may be cheap, durable, and easy to repair, but may be relatively large and include a substantial projection from the surface to which the antenna is mounted.

Recently developed antennas include compact and directional antennas from microwave to millimeter frequency bands utilizing a variety of architectures, such as fractal, smart, chip, and dipole antennas. Although some of the compact antenna designs provide improvements including smaller size and weight, the compact antenna designs fail to provide conformability, or low profile, to the application surface and/or bandwidths which may be reasonably utilized. Additionally, these compact antennas may have limited radiative efficiency when in proximity to metallic surfaces.

BRIEF SUMMARY OF SOME EXAMPLES

Accordingly, some example embodiments may enable an antenna including an electromagnetic metasurface array comprising a plurality of metasurface unit cells, wherein electromagnetic characteristics of the antenna are dynamically tunable by adjusting a bias applied to a tunable dielectric of one or more of the metasurface unit cells.

In another embodiment, a system is provided including an electromagnetic metasurface comprising a plurality of metasurface unit cells, wherein electromagnetic characteristics of the antenna are dynamically tunable and processing circuitry for dynamically tuning the antenna by adjusting a bias applied to a tunable dielectric of one or more of the metasurface unit cells.

BRIEF DESCRIPTION OF THE SEVERAL VIEWS OF THE DRAWING(S)

Having thus described the metasurface antenna in general terms, reference will now be made to the accompanying drawings, which are not necessarily drawn to scale, and wherein:

DETAILED DESCRIPTION

Figure 1:
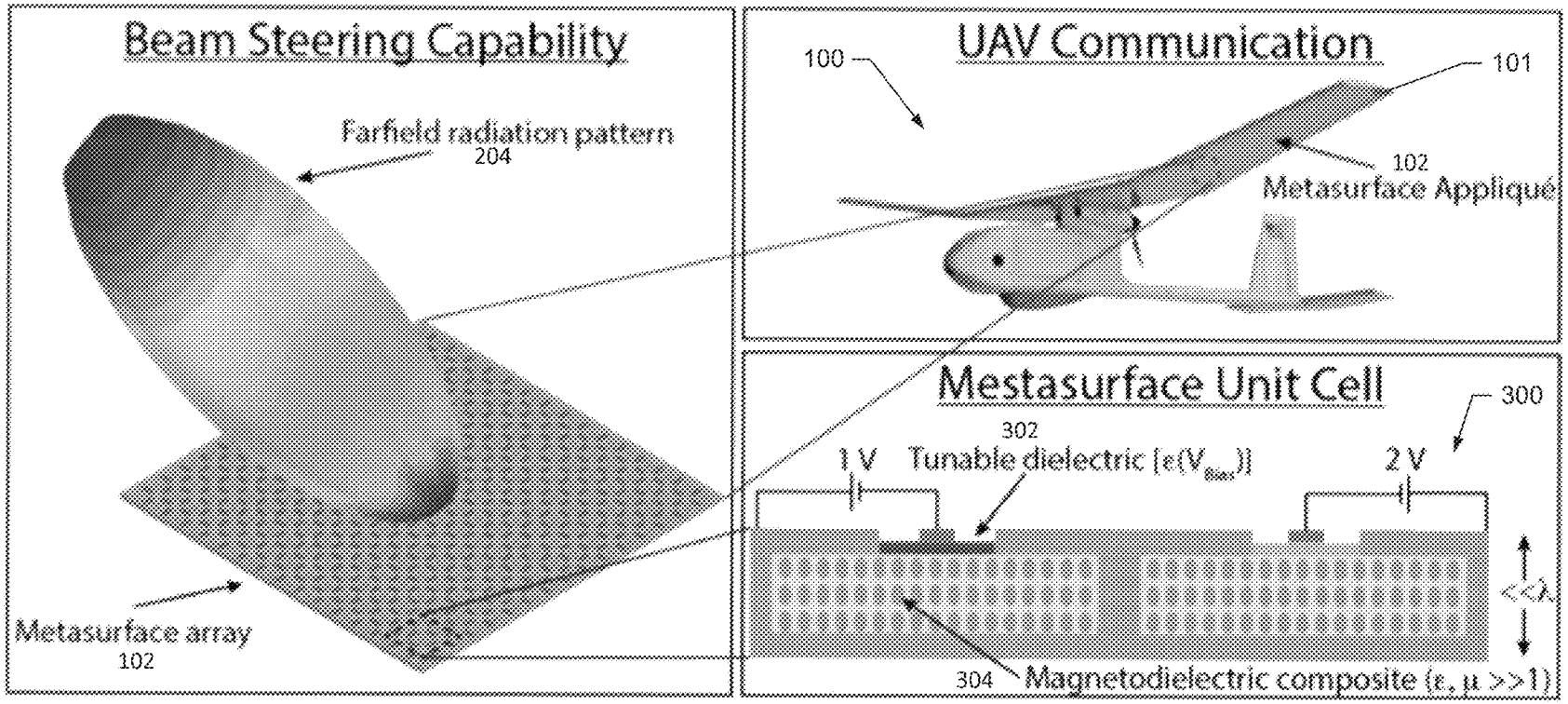
FIG. 1 illustrates an example metasurface antenna array diagram according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. As used herein, operable coupling should be understood to relate to direct or indirect connection that, in either case, enables functional interconnection of components that are operably coupled to each other.

As used in herein, the terms "component," "module," and the like are intended to include a computer-related entity, such as but not limited to hardware, firmware, or a combination of hardware and software. For example, a component or module may be, but is not limited to being, a process running on a processor, a processor, an object, an executable, a thread of execution, and/or a computer. By way of example, both an application running on a computing device and/or the computing device can be a component or module. One or more components or modules can reside within a process and/or thread of execution and a component/module may be localized on one computer and/or distributed between two or more computers. In addition, these components can execute from various computer readable media having various data structures stored thereon. The components may communicate by way of local and/or remote processes such as in accordance with a signal having one or more data packets, such as data from one component/module interacting with another component/module in a local system, distributed system, and/or across a network such as the Internet with other systems by way of the signal. Each respective component/module may perform one or more functions that will be described in greater detail herein. However, it should be appreciated that although this example is described in terms of separate modules corresponding to various functions performed, some examples may not necessarily utilize modular architectures for employment of the respective different functions. Thus, for example, code may be shared between different modules, or the processing circuitry itself may be configured to perform all of the functions described as being associated with the components/modules described herein. Furthermore, in the context of this disclosure, the term "module" should not be understood as a nonce word to identify any generic means for performing functionalities of the respective modules. Instead, the term "module" should be understood to be a modular component that is specifically configured in, or can be operably coupled to, the processing circuitry to modify the behavior and/or capability of the processing circuitry based on the hardware and/or software that is added to or otherwise operably coupled to the processing circuitry to configure the processing circuitry accordingly.

In an example embodiment an antenna is provided including an electromagnetic metasurface. The electromagnetic metasurface allows for dynamic tuning of the electromagnetic characteristics of the antenna.

In some example embodiments, the antenna may incorporate magnetodielectric nanomaterials into an electromagnetic metasurface. Incorporation of the magnetodielectric nanomaterials may provide a high efficiency antenna with large bandwidth that is thin, light weight and conformal to an application surface.

In an example embodiment dynamic tuning elements may be integrated into the electromagnetic metasurface to enable beam steering with an electronic controller, while maintaining the thin, light weight, and conformal structures.

In some example embodiments, a non-Foster circuit may also be embedded into the electromagnetic metasurface, which may increase antenna bandwidth and/or decrease the thickness of the electromagnetic metasurface.

Example Metasurface Antenna Array

FIG. 1 illustrates an example metasurface antenna array diagram according to an example embodiment. A metasurface antenna array 102, e.g. metasurface appliqué may be applied to an application surface 101, of an object 100, such as an unmanned aerial vehicle (UAV). Although described herein as applied to an UAV, the metasurface antenna array 102 may be applied to any surface, such as a building, a water tower, a ship's hull or mast, aeroplane, blimp, satellite, or the like. A transmission distance of the metasurface antenna array 102 may be increased in instances in which the metasurface antenna array 102 is raised from ground, due to a decrease in interference from surrounding objects, such as buildings, earth, trees, or the like.

The metasurface antenna array 102 may include a repeating metasurface pattern covering the application surface 101. In an example embodiment a portion of the metasurface antenna array 102 may receive or transmit in a radio frequency (RF) beam 204, as depicted in FIG. 1, the RF beam 204 is a far field radiation pattern radiating with reasonable antenna gain from the antenna aperture consisting of the metasurface antenna array 102.

The repeating pattern of metasurface antenna array 102 may include a plurality of metasurface unit cells 300. The metasurface unit cells 300 may include an integrated tunable dielectric material 302 operably coupled to a dielectric spacer (e.g. magnetodielectric composite 304). In an example embodiment, the electromagnetic characteristics of the tunable dielectric material 302 allow for beam steering. The tuning of the electromagnetic characteristics may include adjustment of the resonant frequency position, amplitude and/or phase of a radiated RF beam (e.g. RF beam 204). The metasurface antenna array 102 may be dynamically tuned to provide superior antenna gain and/or a wider field of view compared to traditional whip antennas.

Figure 2:
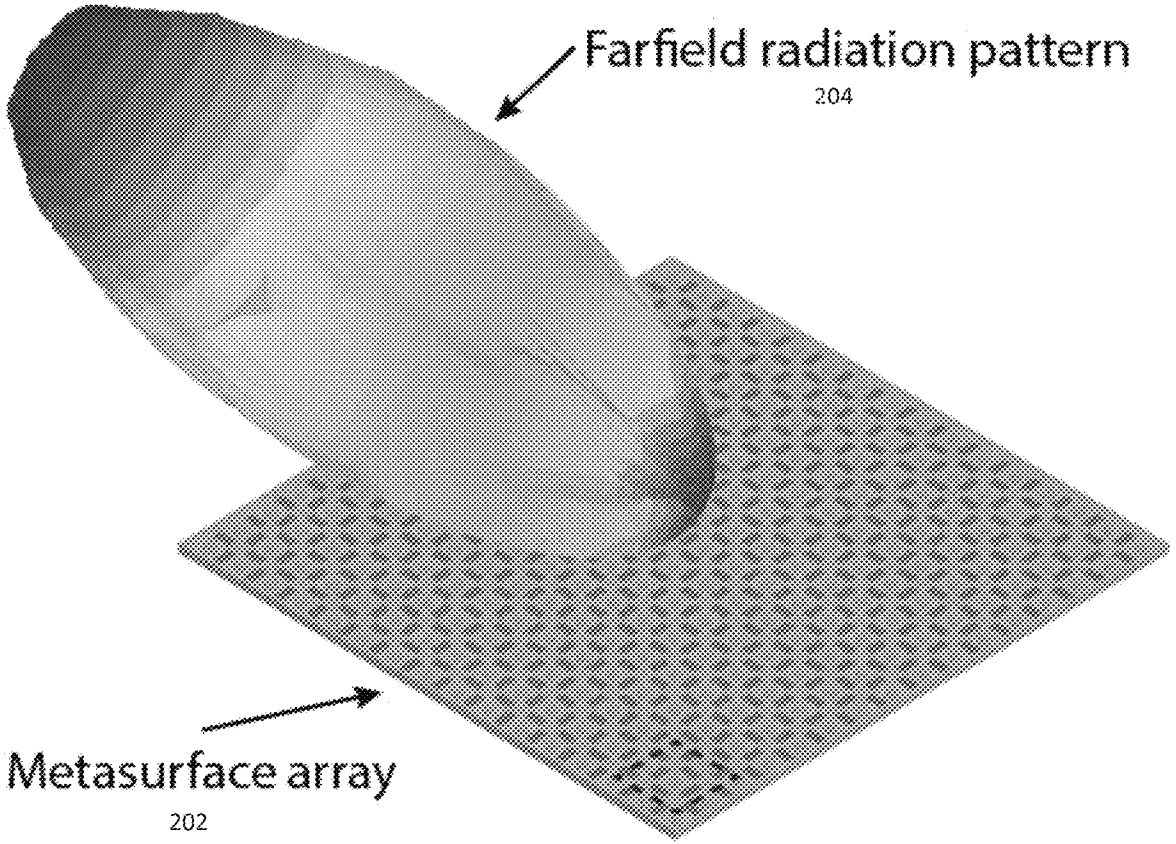
FIG. 2 illustrates an example radiation pattern of the metasurface antenna array according to an example embodiment.
Figure 3:
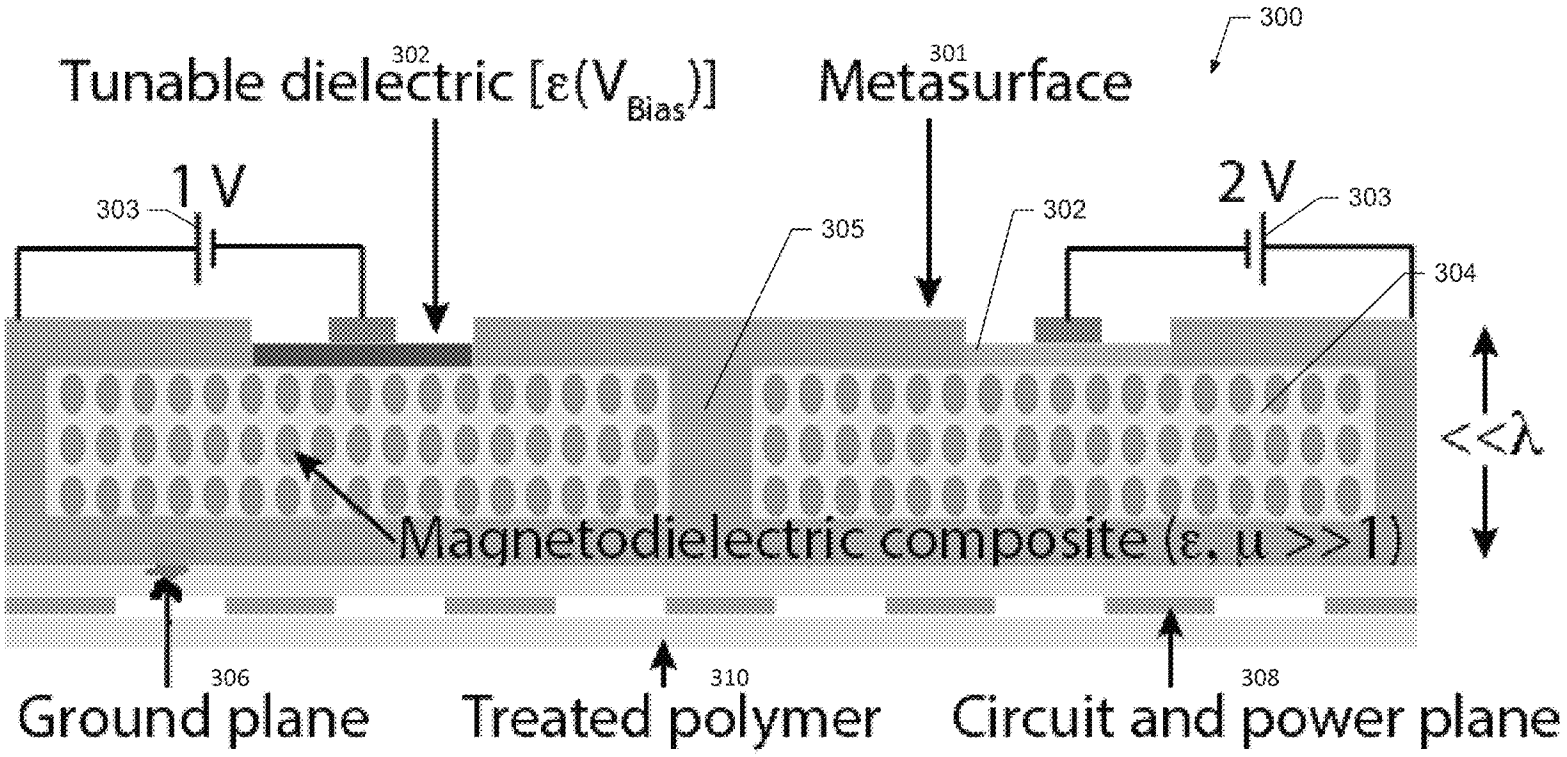
FIG. 3 illustrates an example metasurface unit cell according to an example embodiment.

FIG. 2 illustrates an example radiation pattern of a metasurface antenna array 102 according to an example embodiment. One or more of the metasurface unit cells 300 of the metasurface antenna array 102 may be tuned, as discussed below in reference to FIG. 3, for transmit and/or receive beam steering. In some embodiments, the tuning and beam forming associated with steering beams of the metasurface antenna array 102 may be similar to beam forming and steering in a leaky wave antenna. The metasurface antenna array 102 may include a fast traveling wave radiating along the length of a metasurface 301. A propagation wavenumber kz, for the traveling wave, may be complex, including a phase and an attenuation constant.

In an example embodiment, highly directive RF beams 204, such as the farfield radiation pattern 204, may be formed at a specified angle, with a low sidelobe level. The phase constant $\beta$ of the traveling wave may control the beam angle, which may be controlled by tuning the tunable dielectric material 302 integrated within the metasurface. The attenuation constant $\alpha$ may control the beamwidth.

The metasurface unit cell 300 may include a tunable dielectric material 302, the metasurface 301, tunable elements 303, the dielectric spacer (e.g. magnetodielectric composite 304), a ground plane 306, a circuit and power plane 308, and a treated polymer layer 310.

The metasurface 301 may be an etched antenna element pattern in a metal trace bond, such as gold. A magnetodielectric composite 304 may be disposed between the metasurface 301 and the ground plane 306. The ground plane 306 may also be metal with one or more metal vias 305 electrically coupling the metasurface 301 to the ground plane 306.

The operational bandwidth of the metasurface antenna array 102 may be proportional to $\sqrt{L/C}$, wherein L is the inductance and C is the capacitance of the metasurface unit cell 300. Since L is linearly proportional to sample permeability, $\mu$, a linear increase in $\mu$ may result in a square root increase in the bandwidth of the metasurface antenna array 102.

In an example embodiment, the magnetodielectric composite 304 may include magnetodielectric nanomaterials. The magnetodielectric nanomaterials may be composed of magnetic ferrite nanoparticles infused within a low loss polymer host. The ferrite nanoparticles may include, without limitation, nickel, zinc, cobalt, manganese, and/or iron in various proportions. The magnetodielectric nanomaterials may have high permittivity and permeability values, such as 6, along with low loss values, such as 0.03 for magnetic loss and 0.008 for dielectric loss in a range of 10-200 MHz. In some example embodiments, the magnetodielectric composite 304 may have an increased permeability of a factor of 2 for frequencies of up to 1 GHz, compared to traditional dielectric spacers, and in some examples the permeability may be as high as 5.

In an example embodiment, in plane dimensions of the metasurface unit cell 300 may be subwavlength, such as $<\lambda/4$, and ultra thin, such as $<\lambda/100$. The dimensions of the metasurface unit cell 300 may be beneficial in providing conformal behavior along differing application surface 101 topologies.

The circuit and power plane 308 may be disposed on the ground plane 306 opposite the magnetodielectric composite 304. In an example embodiment, the circuit and power plane 308 may include passive and non-Foster circuits to increase the bandwidth of the metasurface antenna array 102, as discussed below in reference to FIG. 4.

The treated polymer layer 310 may be disposed on the circuit and power plane 308 opposite the ground plane 306. The treated polymer layer 310 may adhere the metasurface antenna array 102 to the application surface 101. In an example embodiment, the treated polymer layer 310 may provide mechanical stability and adhesion between the metasurface antenna array and any arbitrarily shaped application surface 102. Additionally or alternatively, the treated polymer layer 310 may provide electrical and/or magnetic isolation between the metasurface unit cell 300 and the application surface 101.

In an example embodiment, the etched antenna element pattern may be a two dimensional "meta atom" pattern, each meta atom may include one instance of the metasurface unit cell 300. The electromagnetic response of the metasurface 301 may be controlled by the dielectric properties of the individual meta atoms and the electromagnetic interactions between the meta atoms, as discussed below.

The tunable elements 303 may be in electrical connection with the tunable dielectric material 302. The tunable elements 303 and the tunable dielectric material 302 may be disposed in gaps in the metasurface 301 pattern. In an example embodiment, the tunable elements 303 may dynamically adjust the electromagnetic characteristics of the metasurface antenna array 102 by controlling the electromagnetic properties of each meta atom. The tunable elements 303 may dynamically tune the electromagnetic antenna array 102 by controlling the bias voltage applied to the tunable dielectric 302. In an example embodiment, the tunable elements 303 may include, without limitation, liquid crystals, varactors, varistors, photoexcited semiconductor material, and phase changing materials. Spatially locating the tunable elements 303 in the metasurface 301 pattern gaps may allow for dynamic control of the resonant frequency position, the amplitude, and/or phase of a scattered electromagnetic wave, e.g. the transmit and/or receive RF beam 204.

Figure 4:
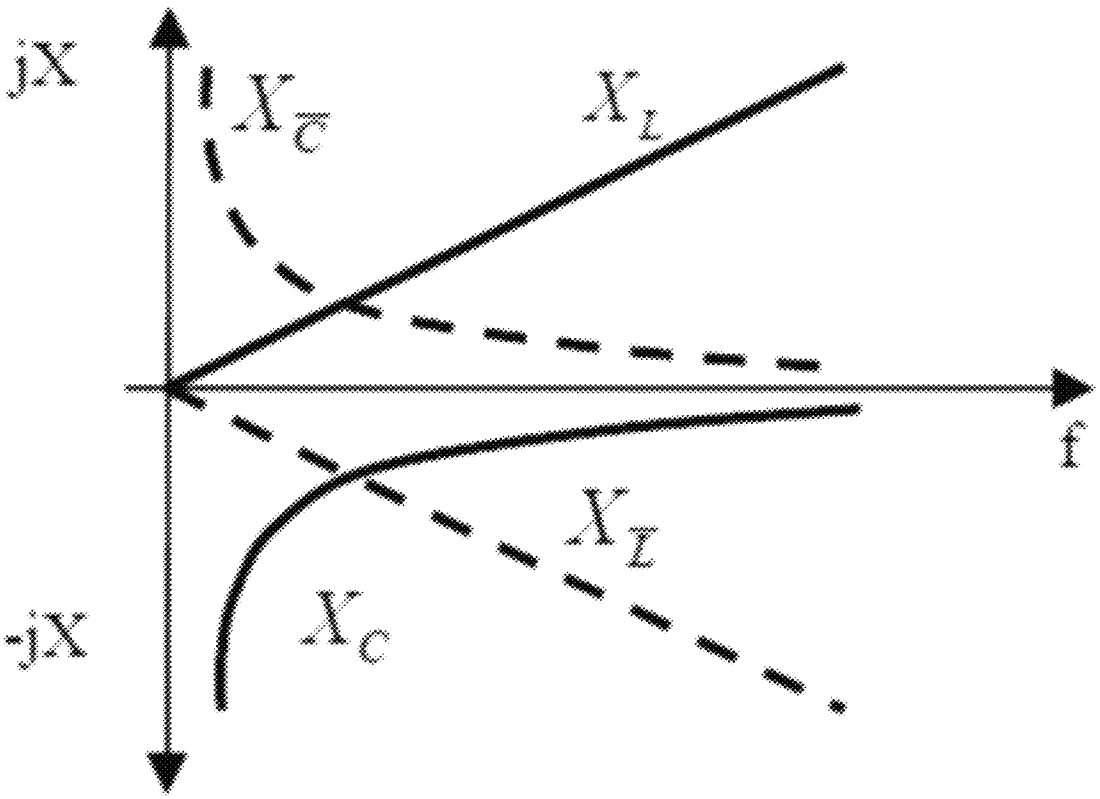
FIG. 4 illustrates example metasurface dispersion patterns according to an example embodiment.

FIG. 4 illustrates example metasurface dispersion patterns according to an example embodiment. For passive materials, including metasurfaces, reactance exhibits an increase with increasing frequency (i.e., $(\partial X/\partial \omega)>0$ for both inductive and capacitive reactance). The increase in inductive and capacitive reactance as frequency increases is depicted by the solid lines. Passive capacitance, $X_C$, increases asymptotically as the frequency, f, increases and inductance, $X_L$, increases linearly.

Non-Foster active elements, or "negative impedance" elements may include electronic circuits that behave as negative capacitors or negative inductors. Negative capacitors and inductors may display dispersion, as depicted by the dashed lines, that is the exact inverse of the dispersion curves of the passive "positive impedance" elements. In an example embodiment, the metasurface unit cells 300 may include a combination of both passive and non-foster impedance circuitry, which may provide complementary impedance increasing the bandwidth of the metasurface antenna array 102.

In some example embodiments, embedding the non-Foster circuit into the metasurface unit cell 300 may additionally decrease the total thickness of the metasurface antenna array while maintaining the radiative bandwidth of the antenna 102.

Figure 5:
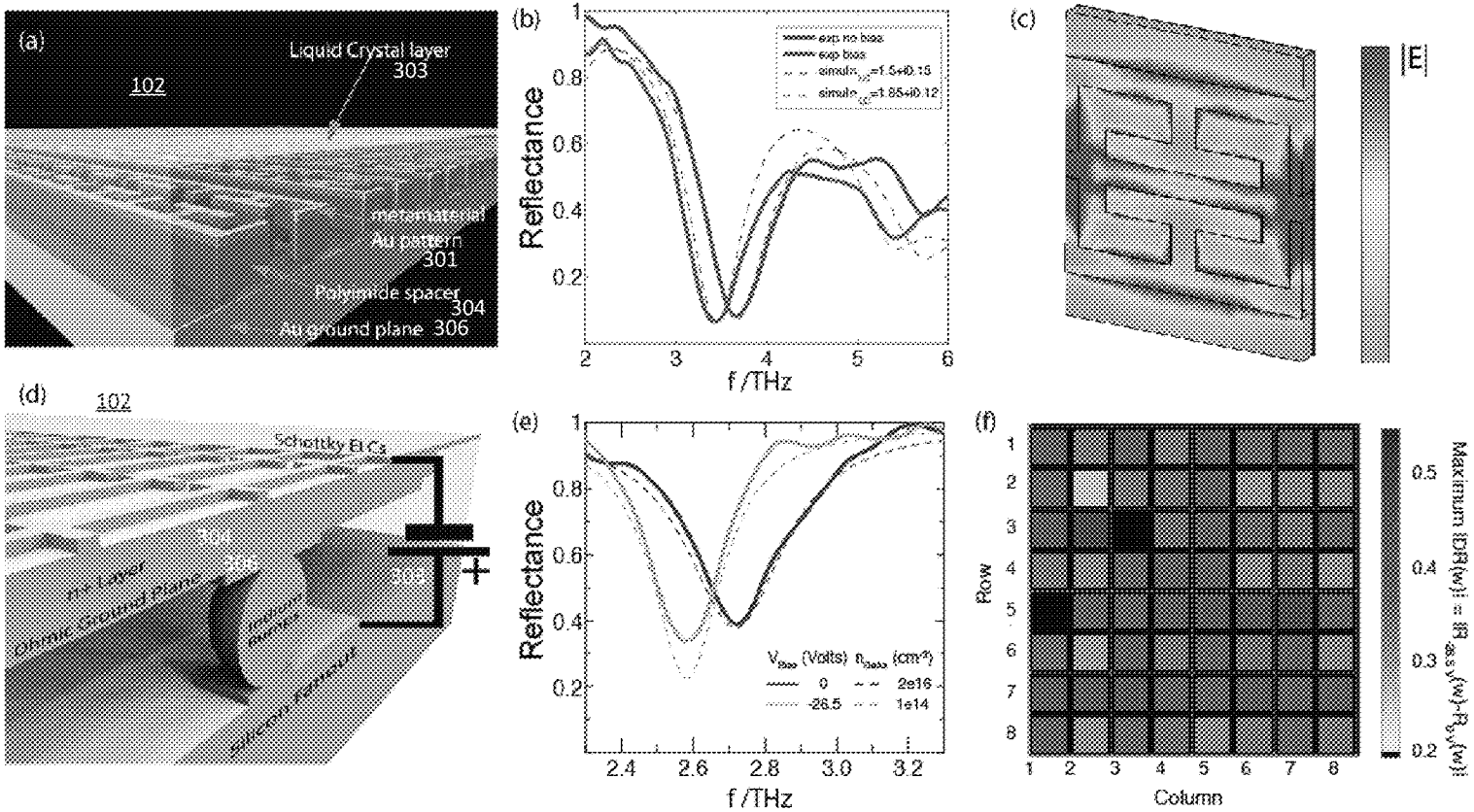
FIG. 5 illustrates an example dynamic tuning of a metasurface antenna array according to an example embodiment.

FIG. 5 illustrates an example dynamic tuning of a metasurface antenna according to an example embodiment. As discussed above in reference to FIG. 3, tuning elements 303 may be provided in the gaps of the metasurface 301 of the metasurface unit cells 300. In an example embodiment, the metasurface antenna array 102 may be dynamically tuned by an electronic controller, such as the apparatus described in FIG. 6. The electronic controller may dynamically tune a transfer function to alter the power received, the transfer through, and/or the reflected energy away from the metasurface 301. The electronic controller may be configured to dynamically tune the metasurface antenna array 102 using the tuning elements 303 for optical, voltage, thermal, or mechanical control. In an example embodiment in which the metasurface antenna array 102 operates in microwave frequencies, the tuning elements 303 may dynamically tune the frequency, amplitude, and/or the phase of the incident electromagnetic radiation, e.g. the RF beam 204, using varactors, diodes, and/or liquid crystals.

Dynamic tuning of a metasurface antenna array 102 with a liquid crystal tuning element 303 is depicted in (a)-(c) of FIG. 5. The metasurface 301 and ground plane 306 of the metasurface antenna array 102 depicted in (a) are gold (Au). The metal layers are separated by a polyimide dielectric layer. The graph depicted in (b) includes frequency on an x axis and reflectance on a y axis. The reflectance decreases initially as frequency increases and then increases to a lower value than the initial reflectance value as frequency continues to increase. FIG. 5 (*c*) depicts the energy dispersion on the metasurface 301 pattern.

Dynamic tuning of a metasurface antenna array 102 with a doped semiconductor material tuning element 303 is depicted in (d)-(f) of FIG. 5. In the metasurface antenna array 102 of FIG. 5 (*d*), the metasurface 301 gaps may include Schottky junction. The dielectric spacer 304 may be an n+ layer and the ground plane 306 may be an ohmic ground plane. Indium bumps may be disposed between the ground plane 306 and a silicon fanout. The n+ layer comprises the tuning element 303, e.g. the doped semiconductor material. The graph depicted in (b) includes a frequency on an x axis and reflectance on a y axis. The reflectance initially decreases from as frequency increases and then increases to a lower value than the initial reflectance value as frequency continues to increase. FIG. 5 (*f*) depicts an 8×8 pixel spatial light modulator (SLM) of the dynamically tuned metasurface antenna array including the doped semiconductor material.

Example Apparatus

Figure 6:
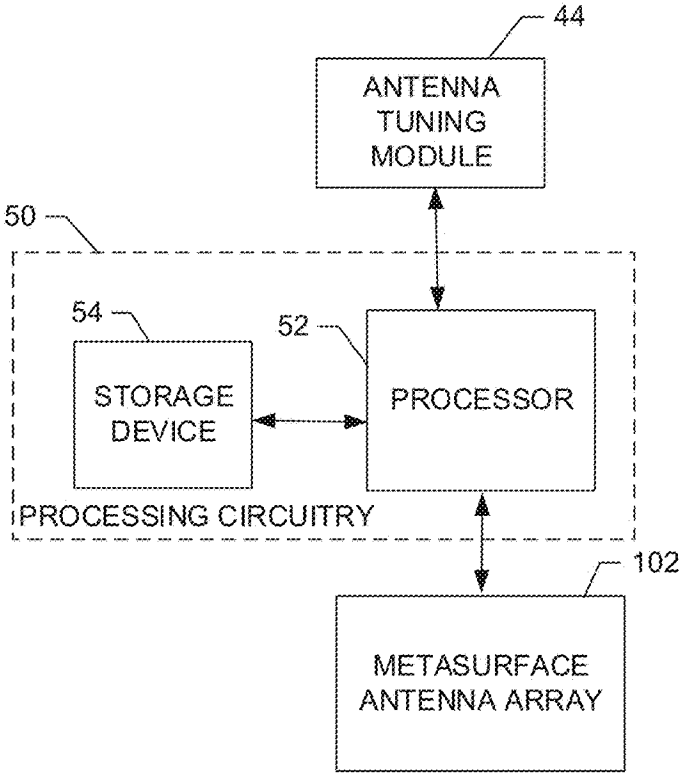
FIG. 6 illustrates an example apparatus for antenna tuning according to an example embodiment.

An example embodiment of the invention will now be described with reference to FIG. 6. FIG. 6 shows certain elements of an apparatus, e.g. electronic controller, for dynamically tuning a metasurface antenna array 102 according to an example embodiment. The apparatus of FIG. 1 may be employed, for example, on a client, a computer, a network access terminal, a personal digital assistant (PDA), cellular phone, smart phone, a network device, server, proxy, or the like. Alternatively, embodiments may be employed on a combination of devices. Accordingly, some embodiments of the present invention may be embodied wholly at a single device or by devices in a client/server relationship. Furthermore, it should be noted that the devices or elements described below may not be mandatory and thus some may be omitted in certain embodiments.

Referring now to FIG. 1, an apparatus configured for dynamic tuning of the metasurface antenna array 102 is provided. In an example embodiment, the apparatus may include or otherwise be in communication with processing circuitry 50 that is configured to perform data processing, application execution and other processing and management services. In one embodiment, the processing circuitry 50 may include a storage device 54 and a processor 52 that may be in communication with or otherwise control or be in communication with, an antenna tuning module 44, and the metasurface array 102. As such, the processing circuitry 50 may be embodied as a circuit chip (e.g., an integrated circuit chip) configured (e.g., with hardware, software or a combination of hardware and software) to perform operations described herein. However, in some embodiments, the processing circuitry 50 may be embodied as a portion of a server, computer, laptop, workstation or even one of various mobile computing devices. In situations where the processing circuitry 50 is embodied as a server or at a remotely located computing device, a user interface may be disposed at another device (e.g., at a computer terminal or client device) that may be in communication with the processing circuitry 50 via a device interface and/or a network).

In an example embodiment, the storage device 54 may include one or more non-transitory storage or memory devices such as, for example, volatile and/or non-volatile memory that may be either fixed or removable. The storage device 54 may be configured to store information, data, applications, instructions or the like for enabling the apparatus to carry out various functions in accordance with example embodiments of the present invention. For example, the storage device 54 could be configured to buffer input data for processing by the processor 52. Additionally or alternatively, the storage device 54 could be configured to store instructions for execution by the processor 52. As yet another alternative, the storage device 54 may include one of a plurality of databases that may store a variety of files, contents or data sets. Among the contents of the storage device 54, applications may be stored for execution by the processor 52 in order to carry out the functionality associated with each respective application.

The processor 52 may be embodied in a number of different ways. For example, the processor 52 may be embodied as various processing means such as a microprocessor or other processing element, a coprocessor, a controller or various other computing or processing devices including integrated circuits such as, for example, an ASIC (application specific integrated circuit), an FPGA (field programmable gate array), a hardware accelerator, or the like. In an example embodiment, the processor 52 may be configured to execute instructions stored in the storage device 54 or otherwise accessible to the processor 52. As such, whether configured by hardware or software methods, or by a combination thereof, the processor 52 may represent an entity (e.g., physically embodied in circuitry) capable of performing operations according to embodiments of the present invention while configured accordingly. Thus, for example, when the processor 52 is embodied as an ASIC, FPGA or the like, the processor 52 may be specifically configured hardware for conducting the operations described herein. Alternatively, as another example, when the processor 52 is embodied as an executor of software instructions, the instructions may specifically configure the processor 52 to perform the operations described herein.

In an example embodiment, the processor 52 (or the processing circuitry 50) may be embodied as, include or otherwise control the antenna tuning module 44, which may be any means, such as, a device or circuitry operating in accordance with software or otherwise embodied in hardware or a combination of hardware and software (e.g., processor 52 operating under software control, the processor 52 embodied as an ASIC or FPGA specifically configured to perform the operations described herein, or a combination thereof) thereby configuring the device or circuitry to perform the corresponding functions of the antenna tuning module 44 as described below.

In some embodiments, the antenna tuning module 44 may comprise stored instructions for handling activities associated with practicing example embodiments as described herein. The antenna tuning module 44 may include tools to facilitate dynamic tuning of the metasurface antenna array 102. In an example embodiment, the antenna tuning module 44 may be configured to dynamically tune the electromagnetic characteristics of the metasurface antenna array 102. In an example embodiment, dynamic tuning the electromagnetic characteristics of the metasurface antenna array 102 may include dynamically tuning the frequency, amplitude or phase of incident electromagnetic radiations. In some example embodiments, the antenna tuning module 44 may utilize one or more adaptive beam forming and/or steering algorithms, such as a least mean squares algorithm, a sample matrix inversion algorithm, a recursive least square algorithm, a conjugate gradient method, or a constant modulus algorithm.

In some example embodiments, the metasurface antenna array 102 may be further configured for additional operations or optional modifications. In this regard, for example in an example embodiment, the metasurface unit cells include a dielectric spacer including a first side and a second side, a patterned metal layer disposed on the first side of the dielectric spacer, and a ground plane disposed on the second side of the dielectric spacer. In some example embodiments, the metasurface unit cells also include a plurality of vias electrically connecting the patterned metal layer and the ground plane. In an example embodiment, the dielectric spacer includes a magnetodielectric composite. In some example embodiments, the magnetodielectric composite includes a magnetodielectric nanomaterial. In an example embodiment, the antenna is conformal to an application surface. In some example embodiments, dynamically tuning the electromagnetic characteristics of the antenna includes beam steering. In an example embodiment, dynamically tuning the electromagnetic characteristics of the antenna includes dynamically tuning the frequency, amplitude, or phase of incident electromagnetic radiation. In some example embodiments, the metasurface unit cells further include one or more tunable elements disposed between the dielectric spacer and the patterned metal layer. In an example embodiment, the antenna includes a non-Foster circuit. In some example embodiments, the non-Foster circuit is configured to provide active control of a bandwidth of the antenna.

Many modifications and other embodiments of the measuring device set forth herein will come to mind to one skilled in the art to which these inventions pertain having the benefit of the teachings presented in the foregoing descriptions and the associated drawings. Therefore, it is to be understood that the measuring devices are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An antenna comprising:

an electromagnetic metasurface array comprising a plurality of metasurface unit cells, wherein electromagnetic characteristics of the antenna are dynamically tunable by adjusting a bias applied to a tunable dielectric of one or more of the metasurface unit cells;

wherein the metasurface unit cells comprise:

a dielectric spacer comprising a first side and a second side;

a patterned metal layer disposed on the first side of the dielectric spacer;

a ground plane disposed on the second side of the dielectric spacer; and one or more tunable elements disposed in gaps of a metasurface formed by the patterned metal layer.

2. The antenna of claim 1, wherein the metasurface unit cells further comprise a plurality of vias electrically connecting the patterned metal layer and the ground plane.

3. The antenna of claim 1, wherein the dielectric spacer comprises a magnetodielectric composite.

4. The antenna of claim 3, wherein the magnetodielectric composite comprises a magnetodielectric nanomaterial.

5. The antenna of claim 1, wherein the one or more tunable elements are further disposed between the dielectric spacer and the patterned metal layer.

6. The antenna of claim 1, wherein the antenna is conformal to an application surface.

7. The antenna of claim 1, wherein dynamically tuning the electromagnetic characteristics of the antenna comprises beam steering.

8. The antenna of claim 7, wherein the non-Foster circuit is configured to provide active control of a bandwidth of the antenna.

9. The antenna of claim 1, wherein dynamically tuning the electromagnetic characteristics of the antenna comprises dynamically tuning the frequency, amplitude, or phase of incident electromagnetic radiation.

10. The antenna of claim 1, wherein the antenna comprises a non-Foster circuit.

11. A system comprising:

an electromagnetic metasurface comprising a plurality of metasurface unit cells, wherein electromagnetic characteristics of the electromagnetic metasurface are dynamically tunable; and processing circuitry configured to dynamically tune the electromagnetic metasurface by adjusting a bias applied to a tunable dielectric of one or more of the metasurface unit cells wherein the metasurface unit cells comprise:

a dielectric spacer comprising a first side and a second side;

a patterned metal layer disposed on the first side of the dielectric spacer;

a ground plane disposed on the second side of the dielectric spacer; and one or more tunable elements disposed in gaps of the electromagnetic metasurface formed by the patterned metal layer.

12. The system of claim 11, wherein the metasurface unit cells further comprise a plurality of vias electrically connecting the patterned metal layer and the ground plane.

13. The system of claim 11, wherein the dielectric spacer comprises a magnetodielectric composite.

14. The system of claim 13, wherein the magnetodielectric composite comprises a magnetodielectric nanomaterial.

15. The system of claim 11, wherein the one or more tunable elements are further disposed between the dielectric spacer and the patterned metal layer.

16. The system of claim 11, wherein the antenna is conformal to an application surface.

17. The system of claim 11, wherein dynamically tuning the electromagnetic characteristics of the antenna comprises beam steering.

18. The system of claim 11, wherein dynamically tuning the electromagnetic characteristics of the antenna comprises dynamically tuning the frequency, amplitude, or phase of incident electromagnetic radiation.

* * * * *